US006826983B1

(12) United States Patent
Magdi

(10) Patent No.: US 6,826,983 B1
(45) Date of Patent: Dec. 7, 2004

(54) LIGHT BULB CHANGER

(75) Inventor: Thomas Magdi, 888 Hamilton Ave., Rockledge, FL (US) 32955

(73) Assignee: Thomas Magdi, Rockledge, FL (US)

( * ) Notice: Subject to any disclaimer, the term of this patent is extended or adjusted under 35 U.S.C. 154(b) by 0 days.

(21) Appl. No.: 10/361,528

(22) Filed: Feb. 10, 2003

(51) Int. Cl.[7] ..... H01K 3/32
(52) U.S. Cl. ..... 81/53.11; 81/52
(58) Field of Search ..... 81/53.1, 53.11, 81/53.12, 54, 57.32, 57.4, 52; 340/825.36

(56) References Cited

U.S. PATENT DOCUMENTS

| | | | | | |
|---|---|---|---|---|---|
| 558,573 | A | | 4/1896 | Smith | |
| 898,696 | A | | 9/1908 | Southworth | |
| 1,847,953 | A | | 3/1932 | Finesey | |
| 2,637,587 | A | | 5/1953 | Robinson | |
| 3,328,592 | A | | 6/1967 | Shaw | |
| 3,473,423 | A | * | 10/1969 | Peck | 81/53.12 |
| 4,068,216 | A | * | 1/1978 | Brouwer et al. | 340/641 |
| 4,314,723 | A | | 2/1982 | Vermillion | |
| D297,499 | S | | 9/1988 | Whitney | |
| 4,901,606 | A | | 2/1990 | Christensen | |
| 5,218,889 | A | | 6/1993 | Brockberg | |
| 5,553,373 | A | * | 9/1996 | Sprayberry | 81/53.11 |
| 5,692,417 | A | * | 12/1997 | Irpino | 81/53.12 |
| 6,127,782 | A | * | 10/2000 | Flory et al. | 315/129 |

* cited by examiner

*Primary Examiner*—Hadi Shakeri
(74) *Attorney, Agent, or Firm*—Brian S. Steinberger; Law Offices of Brian S. Steinberger, P.A.

(57) ABSTRACT

A light bulb changer method and apparatus that contains components that allows for instantly detecting a burned out light, automatically removing the burned out light, and automatically replacing the burned out light with a replacement bulb. The changer operates without human intervention, and can be assembled from a kit having a light fixture, detecting sensor, removing and replacement hardware. The kit can allow a consumer to assemble the changer for use as a novelty item, and/or also to be used as a working light fixture, such as a table lamp, and the like. The changer can also be used as a retrofit for existing light fixtures so that the existing light fixtures can be modified.

13 Claims, 17 Drawing Sheets

FLOW DIAGRAM OF
OPERATIONAL STEPS

LIGHT BULB CHANGER

BACKGROUND AND PRIOR ART

Current light fixtures, such as table lamps, and the like, generally require various types of 30, 55 and 60 watt type bulbs to be used. When a bulb burns out from use, the general procedure is to physically rotate the bulb and then remove the burned out bulb from the fixture socket. Often times, a burned out bulb will not be immediately replaced, which often results in the light fixture being unusable over that down time. Furthermore, many consumers will not have a spare bulb ready, so that further down time occurs waiting for the consumer to purchase a replacement bulb. These problems with changing out burned out bulbs are further compounded in other types of hard to reach and/or commercial type lights, such as those found on ceilings, light poles, and the like.

Current solutions to burned out bulb problems have generally centered on replacement bulbs having extended lifetimes of use over existing bulbs. However, these extended life bulbs are generally many times more expensive than existing bulbs, and these bulbs still have to be manually mounted and replaced.

Various patents have been proposed over the years for changing light type bulbs. See for example, U.S. Pat. No. 5,558,573 to Smith; U.S. Pat. No. 898,696 to Southworth; U.S. Pat. No. 1,847,953 to Finesy; U.S. Pat. No. 2,637,587 to Robinson; U.S. Pat. No. 4,314,723 to Vermillion; U.S. Pat. No. 4,901,606 to Christensen; U.S. Pat. No. 5,218,889 to Brockberg; and Des. 297,499 to Whitney. However, all of these devices generally require the user physically place a portion of the device such as a suction cup or spring type housing over a bulb, and then physically rotate the device. Some of the patents allow for extension type rods, and the like, to be used for ceiling and pole mounted bulbs. Christensen '889 puts motors into their device to aid in the replacement, but still requires the user to determine when a bulb becomes burned out, and also requires the user to physically handle and manipulate the device into position to be used, as well as physically remove the device after it is used.

Thus, the need exists for solutions to the above problems with the prior art.

SUMMARY OF THE INVENTION

The first objective of the present invention is to provide a light bulb changer method and apparatus that immediately and automatically detects a burned out light bulb condition.

The second objective of the present invention is to provide a light bulb changer method and apparatus that automatically changes out a burned out light bulb for a replacement light bulb.

The third objective of the present invention is to provide a light bulb changer method and apparatus that eliminates having to physically contact the light bulb being changed and replaced.

The fourth objective of this invention is to provide a light bulb changer method and apparatus that eliminates having to search out a replacement bulb when a burned out bulb occurs.

The fifth objective of the present invention is to provide a method that eliminates the downtime of a light fixture between discovering a burned out bulb condition and the time it takes to replace the burned out bulb.

Further objects and advantages of this invention will be apparent from the following detailed description of a presently preferred embodiments which is illustrated schematically in the accompanying drawings.

DESCRIPTION OF THE PREFERRED EMBODIMENTS

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

Figure 1:
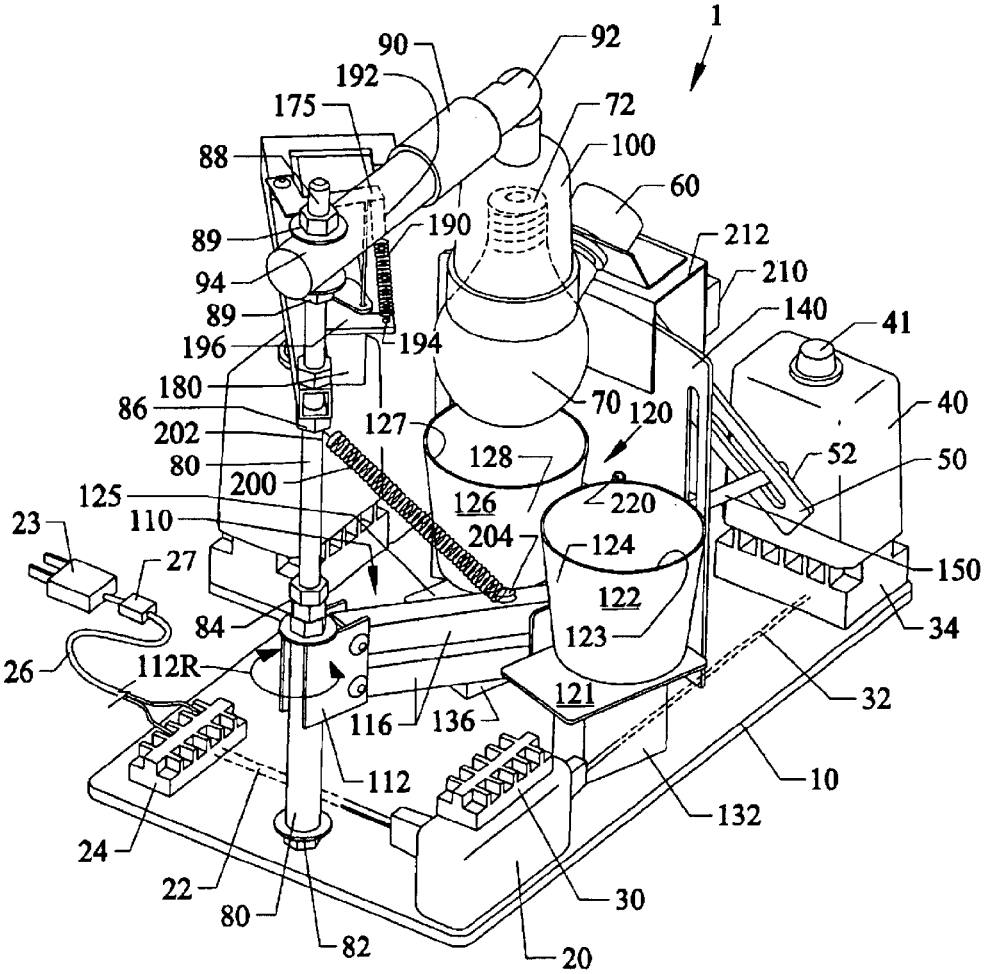
FIG. 1 is a perspective view of a first preferred embodiment of the light bulb changer.
Figure 3:
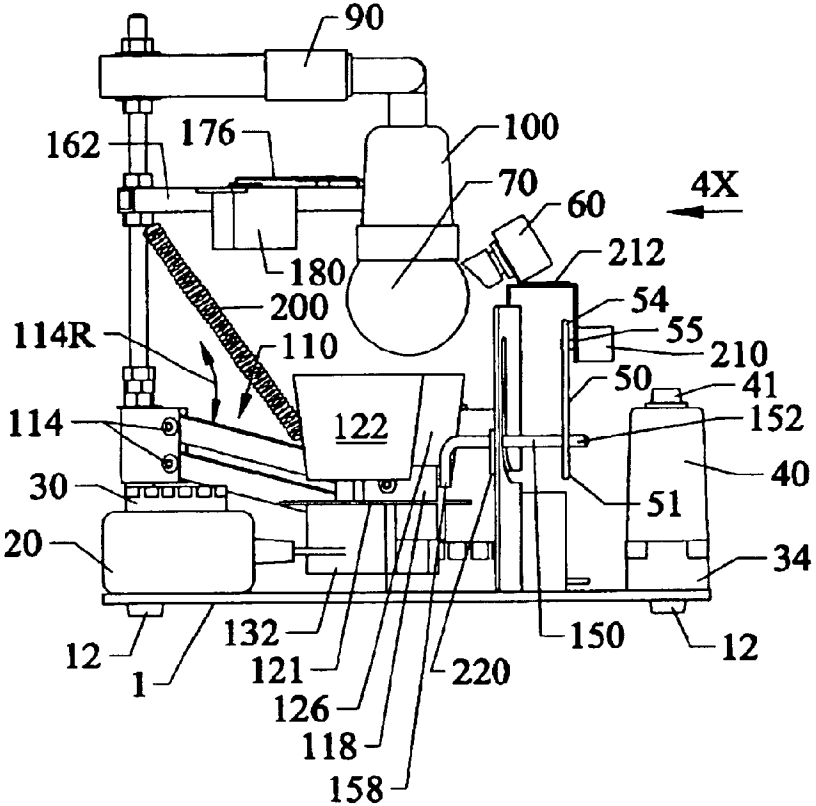
FIG. 3 is a left side view of the light bulb changer of FIG. 2 along arrow 3X.
Figure 2:
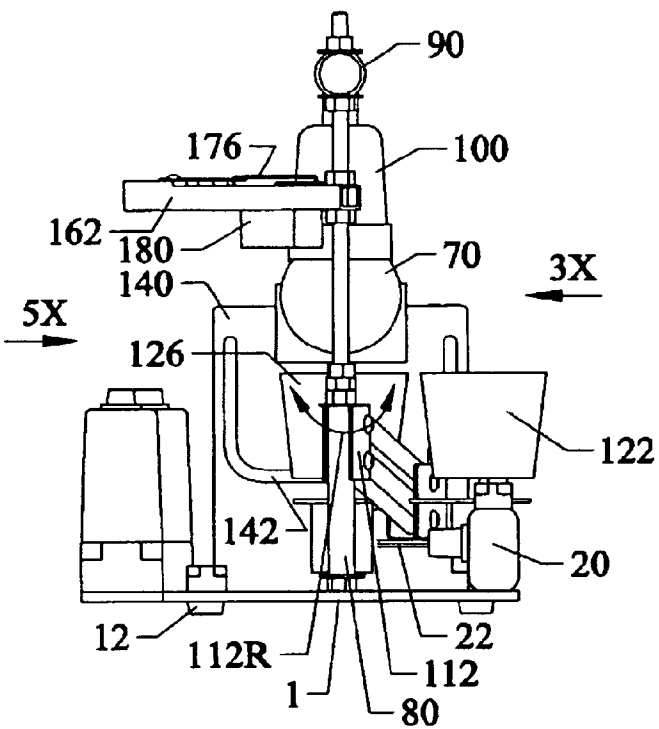
FIG. 2 is a front view of the light bulb changer of FIG. 1.
Figure 5:
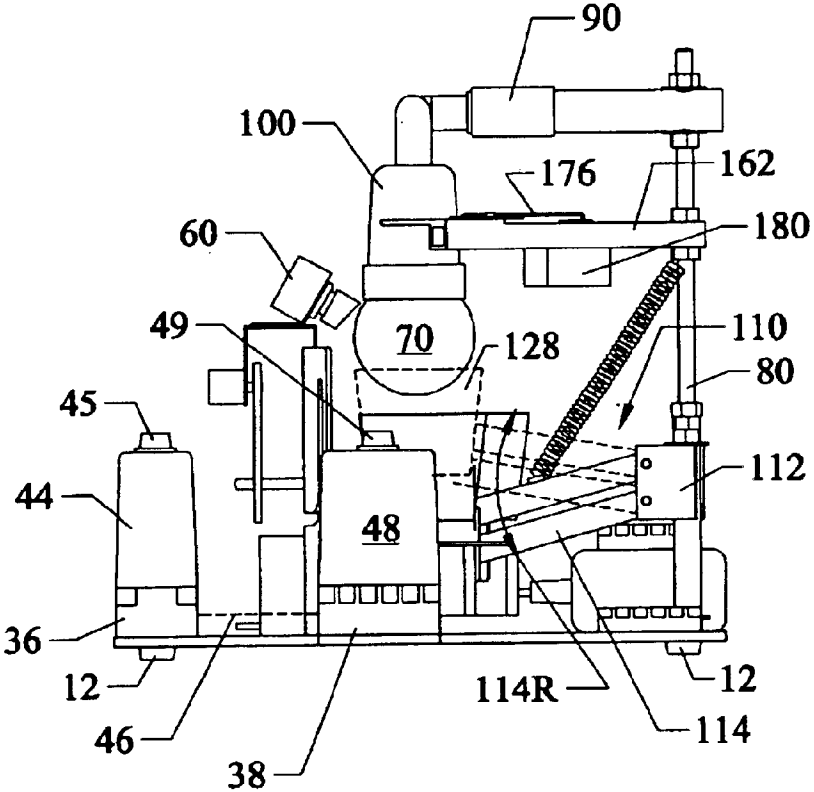
FIG. 5 is a right side view of the light bulb changer of FIG. 2 along arrow 5X.
Figure 4:
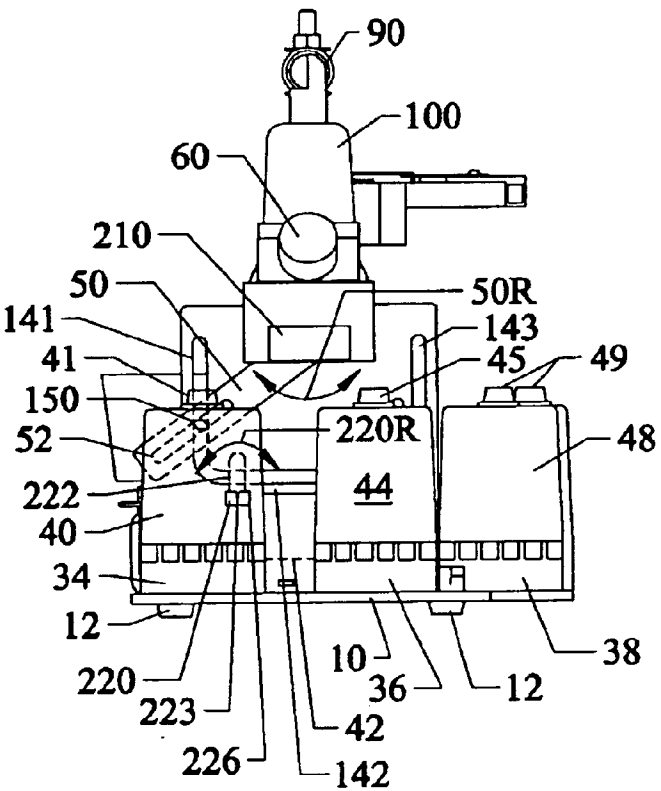
FIG. 4 is a rear view of the light bulb changer of FIG. 3 along arrow 4X.
Figure 6:
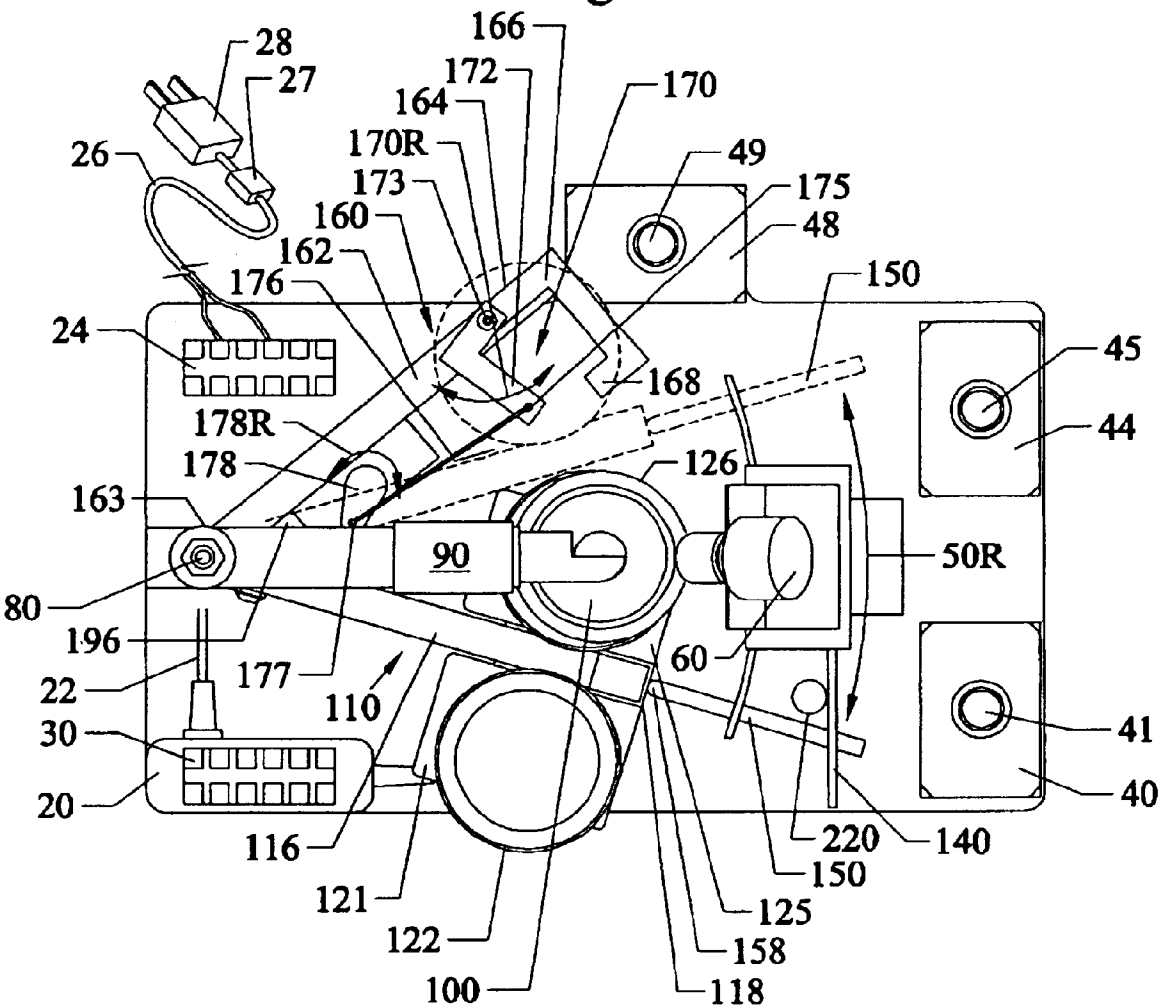
FIG. 6 is a top view of the light bulb changer of the preceding Figures.

FIG. 1 is a perspective view of a first preferred embodiment of the light bulb changer 1. FIG. 2 is a front view of the light bulb changer 1 of FIG. 1. FIG. 3 is a left side view of the light bulb changer 1 of FIG. 2 along arrow 3X. FIG. 4 is a rear view of the light bulb changer 1 of FIG. 3 along arrow 4X. FIG. 5 is a right side view of the light bulb changer 1 of FIG. 2 along arrow 5X. FIG. 6 is a top view of the light bulb changer 1 of the preceding Figures.

A list of the components for the figures will now be defined.

1 Light Bulb Changer
10 Platform Base
12 Rubber Feet
20 Power Supply Transformer
22 power line
24 terminal
26 power line
27 power switch
28 wall plug
30 terminal on transformer 20
32 wire line connector
34 terminal under first relay control 40
36 terminal under second relay control 44
38 terminal under third relay control 48
40 First Relay Control
41 Rotatable Knob on First Relay Control 40
42 line connector between controls 40, 44
43 solid state cube relay
44 Second Relay Control
45 Rotatable Knob on Second Relay Control 44
46 line connector between controls 44, 48
48 Third Relay Control
49 Rotatable Knob on Third Relay Control
50 Cam follower transfer arm
51 Outer end of arm 50
52 Longitudinal slot along outer end 51 of arm 50
54 Inner end of arm 50
55 Rotatable axle pin for arm 50
50R Double arrow showing rotating directions of arm 50
60 Optical sensor determines burnout condition
70 Light bulb in lit condition monitored by optical sensor 60
72 Threaded stem of bulb 70
75 Replacement bulb
77 Threaded stem of replacement bulb
90 light boom for connecting socket 100 to post 80
92 outer swivel end of boom
94 inner end of boom attached to post 80
100 light socket for bulb 70
210 Servo Motor for Rotating pin 55
212 C-shaped Bracket connects motor 210 to cam groove plate 140
140 Cam groove plate
142 U-shaped slot in groove plate 140
141 Upper left slot stop end
143 Upper right slot stop end
150 Cam follower bar
152 Outer end of bar 150
158 Inner end of bar 150
110 Articulating transport arm assembly
112 Inner end of arm assembly about post 80
112R double arrow horizontal rotating horizontal plane direction of arm assembly 110 about post 80
114 pivot end of double arms 116 of assembly 110
114R Double arrow vertical pivoting rotation plane direction of arm assembly 110
116 Double arms on arm assembly 110
118 Outer end of arms 116
120 Bulb griping cup assembly 120
121/125 platforms for bulb cup holders 122, 126
122/126 Bulb cup holders
123/127 Mouths of cup holders 122/126
124/128 inwardly Sloping side walls of cup holders 122/126
132/136 Servo motors for bulb cup holders 122/126
80 Main Support Rod Post
82 lower mounted end of Support Rod post
84 nut/washer for stopping upward movement of rotatable assembly end 112 about post 80
86 nut/washer attached to upper end of spring 200
88 upper end of post 80
89 fasteners(nuts/washers on upper end 88 of post 80
200 Stabilizing spring for articulating arm assembly
202 upper end of spring 200
204 lower end of spring 200
160 Bulb Stem grip assembly
162 arm portion of grip assembly 160
163 inner end of arm 162
164 portion of arm 162 where finger 172 pivots
166 outer fixed bulb stem grip finger with L-shape
168 inwardly facing tip end of L-shaped grip finger
170 moveable bulb stem grip finger
172 L-shaped portion of finger 170
173 pivotal end connection of finger 170
175 opposite end of grip finger 170
176 grip finger link
177 pivot correction link 176
178 rotatable cam
178R rotatable direction of cam 178
190 grip finger return spring
192 spring end attached to grip finger portion 172
194 spring end attached to flange plate 196
196 flange plate attached to base portion 163 of grip assembly arm 162
180 servo motor controlling cam 178
220 Cam follower locater switch
300 see-through shield/dome
400 lamp shade attachment
500 demonstration operation switch/coin operation switch/money operation switch A detailed description of the components in relation to the Figures will now be described. Referring to FIGS. 1-6, light bulb changer 1 can include a base 10, such as a platform with lower extending feet portions 12, such as rubber footers, and the like, for supporting the platform base 10, on a surface such as a table, desk, and the like. On platform base 10, can be a power supply transformer 20 which connects the changer 1 to a wall plug 28 power source such as a 120 volt power supply by way of wires 26, terminal 24, and power line 22. A terminal 30 connects transformer 20 by wire line connector 32 to a terminal 34 under First Relay Control 40, such as a solid state time delay relay manufactured by Dayton, which can be adjusted to operate at a delay time of approximately 0.1 to 10 seconds, by selecting a setting with rotatable control knob 41. Line 42 connects First Relay Control 40 to terminal 36 under Second Relay Control 44, such as a solid state time delay relay manufactured by Dayton, which can be adjusted to operate at a delay time of approximately 1 second to approximately 60 seconds, by selecting a setting with rotatable control knob 45. Line 46(FIG. 5) connects Second Relay Control 44 to terminal 38 under Third Relay Control 48, such as another solid state time delay relay manufactured by Dayton, which can be adjusted to operate at a delay time of approximately 1 to approximately 180 seconds by selecting a setting with rotatable control knob 49.

Referring to FIGS. 1-6, a rectangular plate 140 can be perpendicularly and fixably mounted to an upper surface of base platform 10. Plate 140, also called a cam groove plate, can have a U-shaped slot 142 having an upper left slot stop end 141 and an upper right slot stop end 143 therein. Attached to the top of plate 140 can be a downwardly facing C-shaped bracket 212 which supports a servo type motor 210 thereon. Servo motor 210, can rotate pin 55 that is connected to inner end 54 of cam follower arm 50 in the direction of double arrows 50R. A longitudinal slot 52 is through arm 50 running within outer arm end 54.

Fixably mounted to base platform 10 can be the lower end 82 of a main threaded support rod post 80. An articulating double arm assembly 110 has an inner end 112 which can rotate in a horizontal plane in the direction of double arrows 112R about support rod post 80, and is held in place by rotatably abutting against fixed nut/washer 84 which is threadably attached about a lower third portion of rod post 80. Adjacent inner end 112, can be pivoting arm ends 114 of arms 116, which pivotably rotate up and down in a vertical plane in the direction of double arrows 114R.

A cam follower bar 150 has an inner end 152 fixably mounted to outer end portion 118 of articulating arm assembly 110.

Servo motor 210 rotates cam arm 50 in the direction of double arrows 50R, which allows for outer end 158 of cam follower bar 150 to slide between upper left slot end 141 to upper right slot stop end 43 within U-shaped slot 142 that is in groove plate 140.

Moving the cam follower arm 150 then moves articulating arm assembly in the direction of double arrows 112R in the horizontal plane about rod post 80 while pivotably rotating the double arms 116 up and down in the direction of arrows 114R in the vertical plane about end 112 of the arm assembly 110 which is adjacent to rod post 80.

Referring to FIGS. 1, 3, 4 and 6, a cam follower switch 220 can be attached to the back of cam groove plate 140 adjacent to a lower left horizontal portion of U-shaped slot 142. Switch 220 includes an upwardly protruding stem portion 222, which is springably pivotally fixed in an upwardly protruding perpendicular direction from a fixed base portion 226. As the cam follower bar slides through and travels through the U-shaped slot 142, the horizontally oriented bar 50 moves the moveable stem portion 222 of switch 220 in the direction of double arrows 220R Referring to FIGS. 1 and 3, stabilizer spring 200 for arm assembly 110 has an upper end 202 fixably attached to an upper mid-portion 86, such as a nut/washer threadably attached to rod support post 80 and a lower end 204 attached to a mid-portion along double arms 114.

Referring to FIGS. 1, 3-6, a light sensor 60, such as but not limited to an optical sensor, U.L. photoelectric switch rated for 120 VAC, model #870J, can be mounted to the upper portion of the C-shaped bracket 212, and is continuously aimed at the existing lit light bulb 70, in order to determine, whether the light bulb 70 is burned out, or not. Alternatively, an electrical type switch can be used instead of the optical sensor 60, which can be wired to the bulb 70 power supply, which would also indicate when a burned out condition exists.

Referring to FIGS. 1-6, the monitored light bulb 70 can include a standard light bulb, such as but not limited to a Sylvania 40 W soft light bulb, having a threaded stem 72 that screws into a socket 100, which in turn is suspended in a downward perpendicular direction from a swivel connector 92 on one end of a horizontal light boom 90. An opposite end 94 of the horizontal boom 90 can be fixably attached to an upper end 88 of the rod post 80 by fasteners 89 such as nuts/washers.

Attached to both sides of the outer end portion 118 of articulating arm assembly 110, can be bulb gripping cup assembly 120, having two platforms 121, 125 for each supporting bulb cup holders 122, 126 thereon. Each of the cup holders can be formed from thin walled flexible plastic type cups having open mouth portions 123, 127, with inwardly sloping side walls 124, 128, respectively. Attached to the underside of platforms 121, 125, can be respective Servo motors 132/136 for bulb cup holders 122/126

Referring to FIGS. 1-3, 5 and 6, bulb stem grip assembly 160 includes an arm portion 162 having an inner end 163 attached to an upper end 88 of rod post 80 by fasteners 89, and an opposite fixed bulb stem grip finger 166 having an L-shape, with inwardly facing tip end 168. A moveable bulb stem grip finger 170 can include a L-shaped portion 172 having one end 173 pivotally connected by a pin, and the like, to an portion 164 of arm portion 162 of the bulb stem grip assembly 160 where L portion pivots. The opposite end 175 of moveable grip finger 170 is pivotally attached to a moveable grip finger link 176, which is turn is pivotally connected at an opposite end 177 to a rotatable cam 178, such that rotating the cam 178 in the direction of double arrows 178R, moves the finger link 176 such that moveable grip finger 172 pivotally moves in the direction of double arrows 170R, respectively. A grip finger return spring 190 has one end 192 attached to the outer end of moveable grip finger 172, and an opposite end 194 attached to a flange plate 196, that is attached to the base portion 163 of griping assembly arm 162. The grip finger return spring 190 is biased to keep the moveable finger 172 in an open position. A servo motor 180 attached underneath plate 196 operates the rotatable cam 178 to open and close the moveable finger 172.

An operating description of the novel changer embodiment will now be described in reference to FIGS. 7A-14B.

Initial Rest Position

Figure 7A:
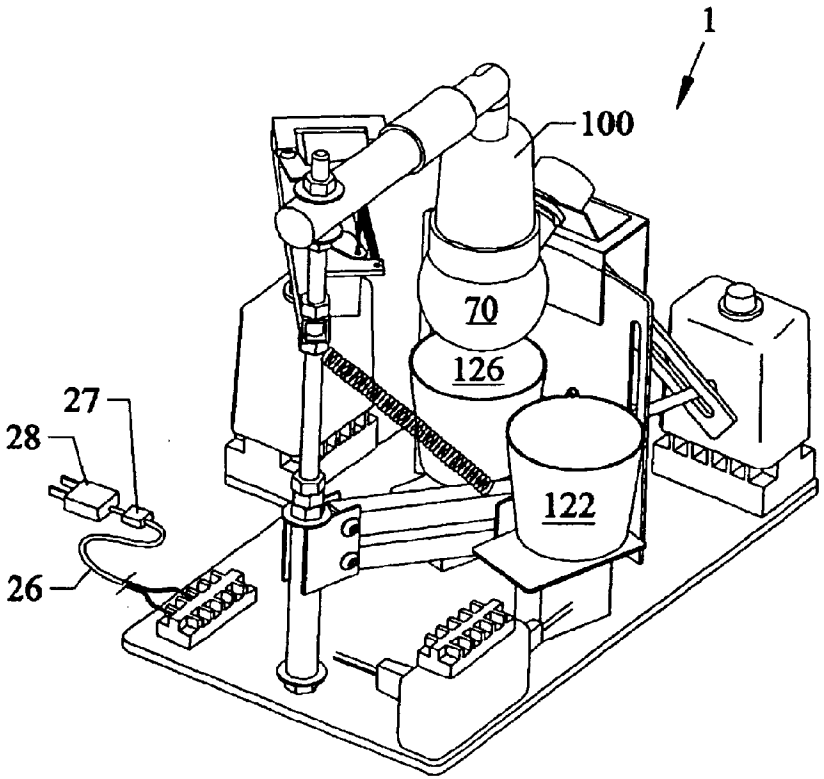
FIG. 7A is a front perspective view of the light bulb changer ready to accept a replacement bulb prior to operation.
Figure 7B:
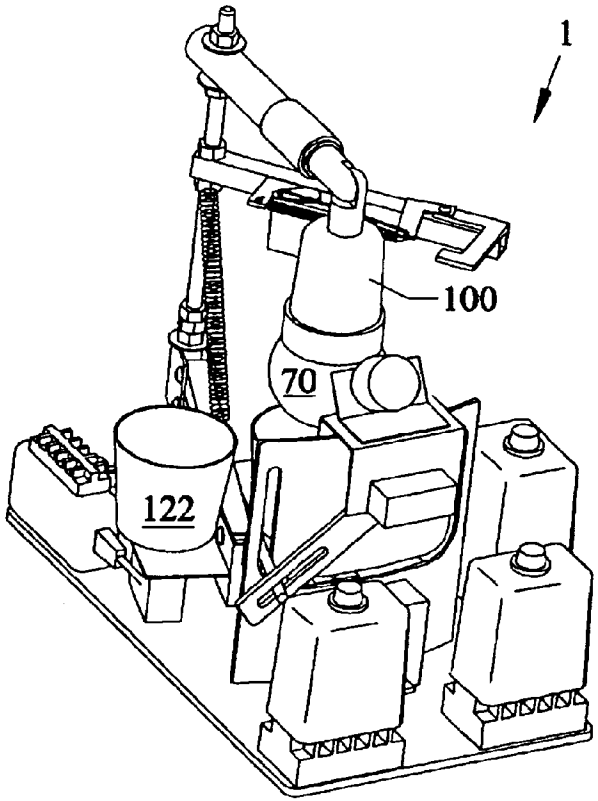
FIG. 7B is a rear perspective view of the light bulb changer of FIG. 7A.

FIG. 7A is a front perspective view of the light bulb changer 1 ready to accept a replacement bulb in cup holder 122 prior to operation. FIG. 7B is a rear perspective view of the light bulb changer 1 of FIG. 7A. The changer 1, can have an existing bulb 701 light socket 100, where the bulb 70 can be powered on by a wall plug 28, and/or a toggle type switch 27, and the like.

Figure 8:
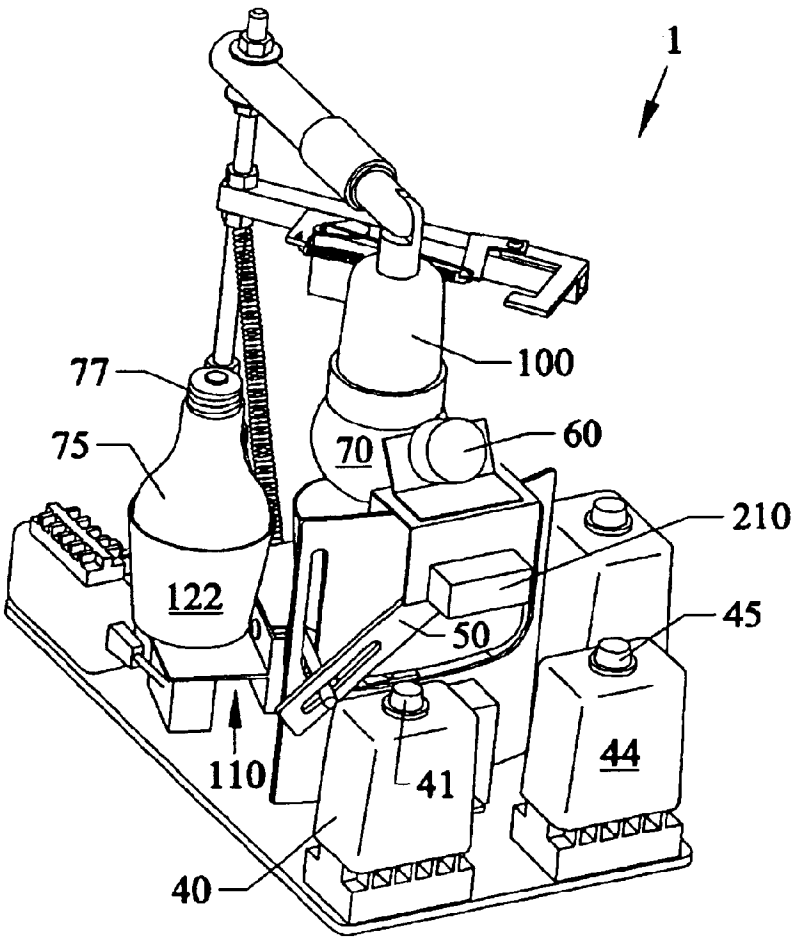
FIG. 8 is a rear perspective view of the light bulb changer of FIG. 7B with replacement bulb.

FIG. 8 is a rear perspective view of the light bulb changer 1 of FIG. 7B with replacement bulb 75 with threaded stem portion facing upward positioned in replacement bulb cup holder 122. At this point the changer 1 is ready for operation, and the existing bulb 70 can be turned on to.

Burned Out Bulb Condition & Extraction

The components of the changer 1, stays in the position shown in FIGS. 7A, 7B and 8, until a burned out bulb condition in bulb 70 is detected by optical type sensor 60.

Figure 9A:
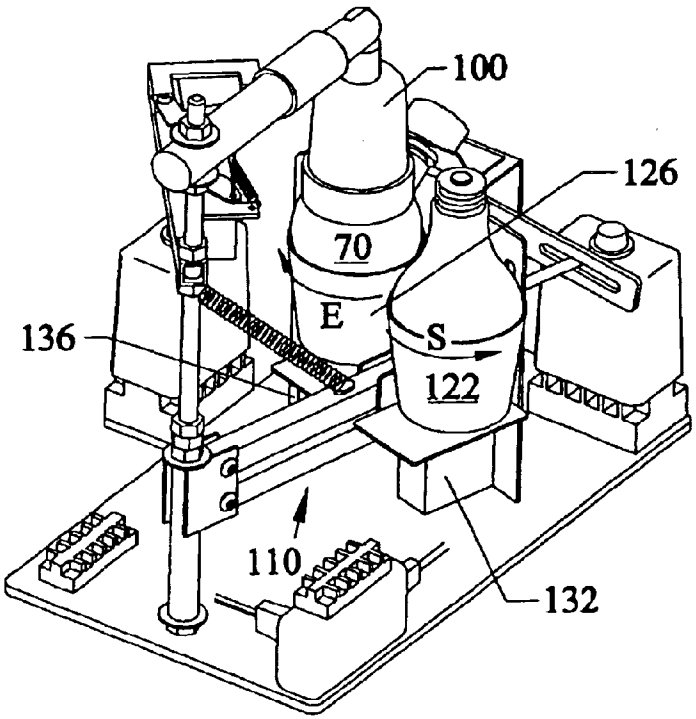
FIG. 9A is a front perspective view of the preceding figures with cam follower arm moving to cause removal of the burned out bulb following detection of the burned out bulb condition.
Figure 9B:
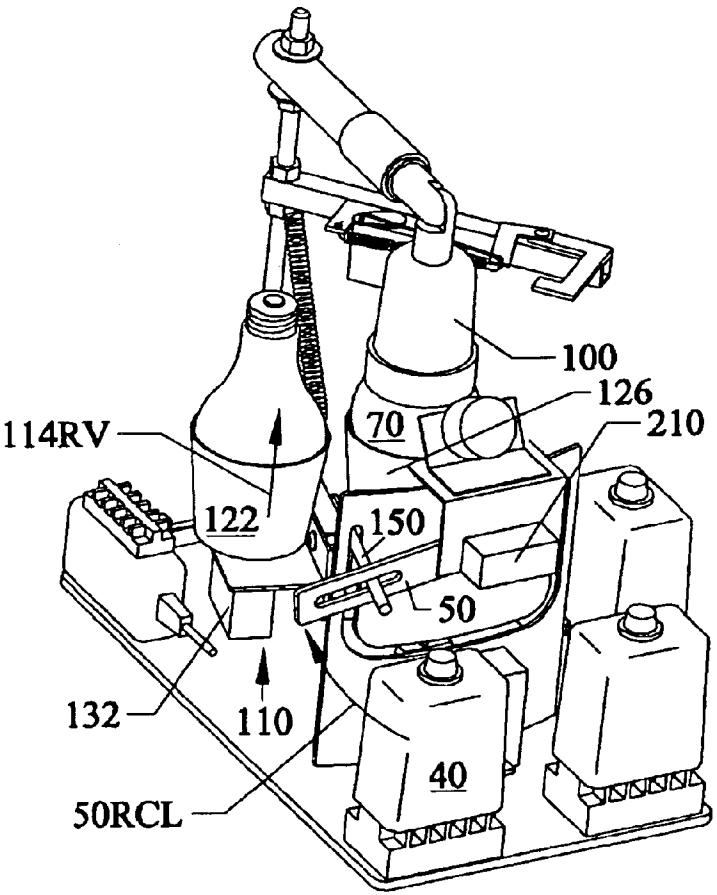
FIG. 9B is a rear perspective view of FIG. 9A.

FIG. 9A is a front perspective view of the preceding figures with cam follower arm moving to cause removal of the burned out bulb following detection of the burned out bulb condition. FIG. 9B is a rear perspective view of FIG. 9A.

Referring to FIGS. 8, 9A and 9B, the burned out bulb condition in bulb 70 can be immediately detected by sensor 60, which turns on transformer 20, which operates 6 volt bulb cup servo motors 132, 136, grip finger servo motor 180, and cam follower transfer arm servo motor 210. Detection of burned out condition by sensor 60 also turns first relay control 40, to operate the cam follower transfer arm 50 to rotate clockwise(see arrow 50R) which moves cam follower bar 150, and move articulating transport arm assembly 110 to move upward (see arrow 114R) so that cup holder 126 to securely and tightly wrap about burned out bulb 70 so that the changer 1 is in an extraction position(FIGS. 9A-9B). Simultaneously, as the transport arm assembly 110 is being raised, cup holder 126 is being rotated counter-clockwise in the direction of arrow E, for an extraction, and cup holder 122 is being continuously rotated in clockwise in the direction of arrow S (FIG. 9A). First relay control 40 can be adjusted by knob 41 to a selected time position such as approximately 8 seconds. The changer 1, allows for the cup holder 126 to continue to unscrew burned out bulb 70, and then time out by the setting in first relay control 40.

Removing Burned Out Bulb

Figure 10A:
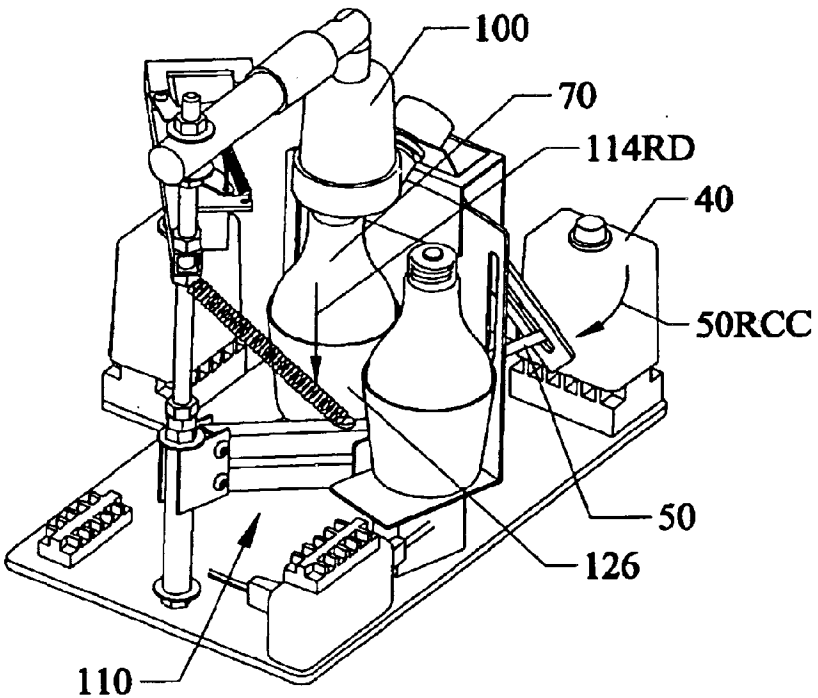
FIG. 10A is a front perspective view of the changer removing the burned out bulb.
Figure 10B:
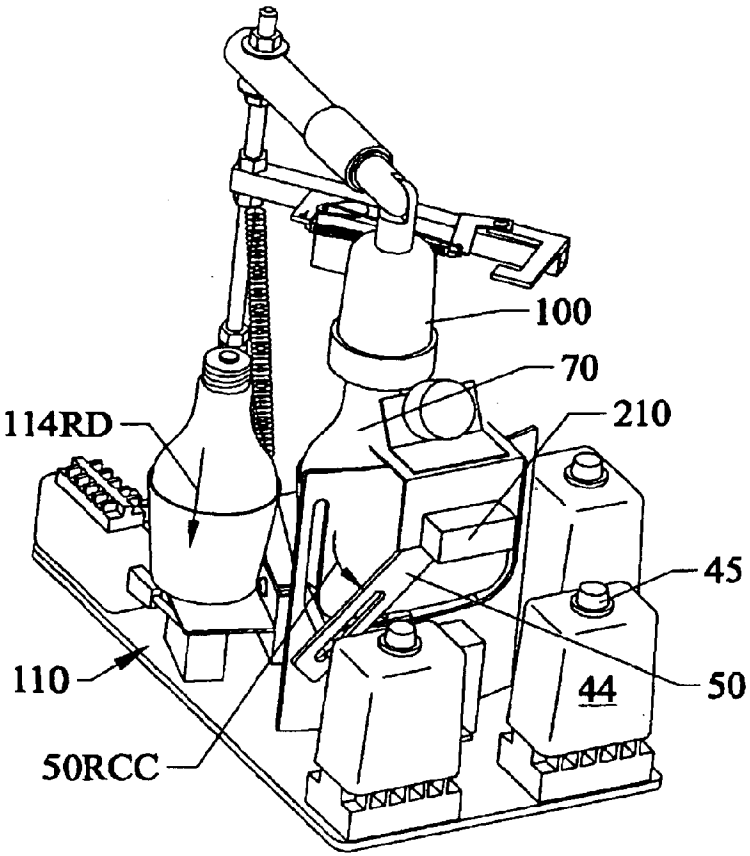
FIG. 10B is a rear perspective view of FIG. 10A.

FIG. 10A is a front perspective view of the changer 1 removing the burned out bulb 70. FIG. 10B is a rear perspective view of FIG. 10A. After first relay control 40 times out, the second relay control 44 turns on sending a reverse polarity DC current to cam follower transfer arm servo motor 210 to rotate cam follower transfer arm 50 counter clockwise in the direction of arrow 50RCC, which moves the transport arm assembly 110 downward in the direction of arrow 114RD so that unscrewed bulb 70 is separated and is removed from socket 100.

Moving Replacement Bulb Under Socket

Figure 11A:
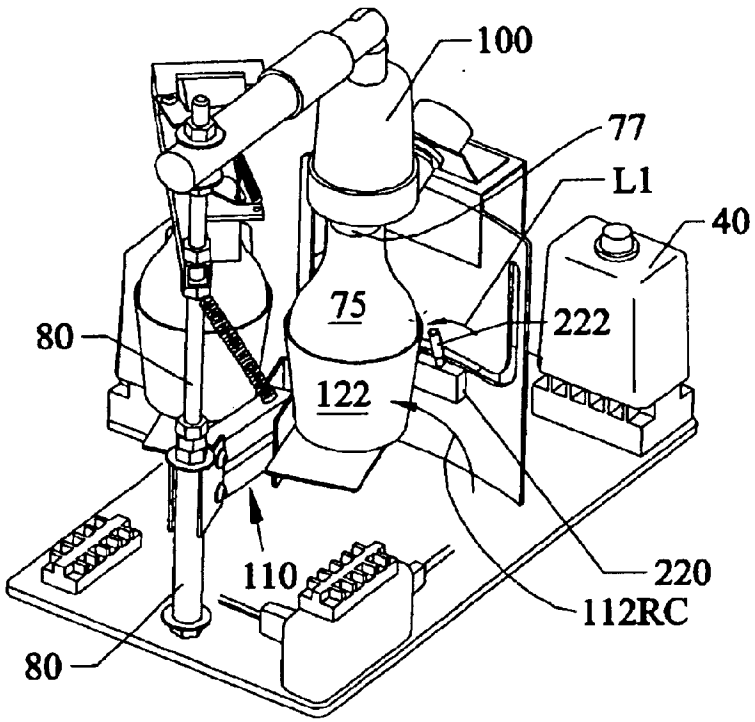
FIG. 11A is a front perspective view of the changer moving the replacement bulb under the empty light socket.
Figure 11B:
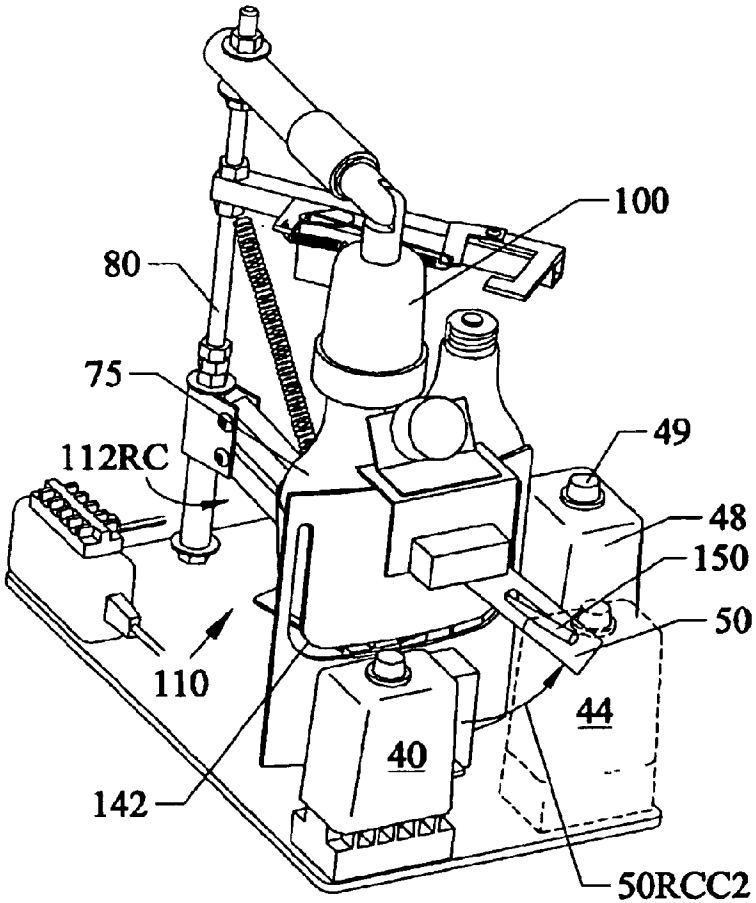
FIG. 11B is a rear perspective view of FIG. 11A.

FIG. 11A is a front perspective view of the changer 1 moving the replacement bulb 75 under the now empty light socket 100. FIG. 11B is a rear perspective view of FIG. 11A. After burned out bulb 70 is detected, relay 44 can turn on for approximately 10 seconds. Second relay control 44, which can be adjusted by knob 45, to run for a selected time period when activated, such as for approximately 10 seconds, continues to cause cam follower transfer arm 50 to rotate in the direction of arrow 50RCC2, causing the cam follower bar 150 to pass through the lower portion of the U-shaped slot 142, and moving toggle stem 222 of switch 220 in the direction of arrow L1, which then activates the third relay control 48 which can be adjusted to be activated in approximately 10 seconds. As transfer arm 50 is rotating in the direction of arrow 50RCC2, the cam follower bar 150 moves the articulating arm assembly 110 in the direction of arrow 112RC respective to rod post 80 so that the threaded stem 77 of the replacement bulb 75 is positioned under socket 100.

Replacement Bulb Positioning, and Burned Out Bulb Removal

Figure 12A:
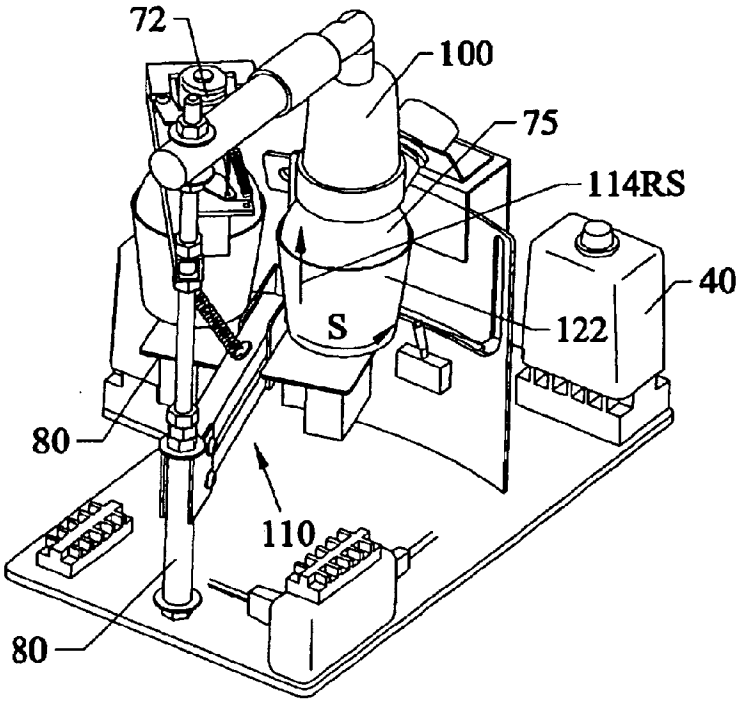
FIG. 12A is a front perspective view of the changer inserting the replacement bulb in the socket, and also griping the burned out bulb.
Figure 12B:
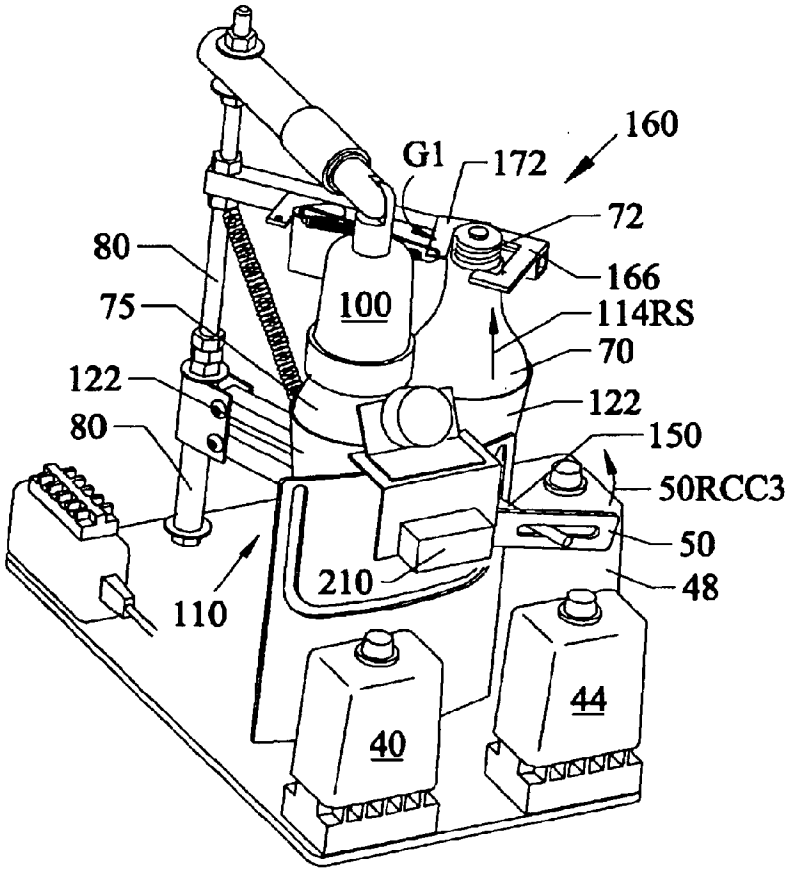
FIG. 12B is a rear perspective view of FIG. 12A.

FIG. 12A is a front perspective view of the changer 1 inserting the replacement bulb 75 in the socket 100, and also griping the burned out bulb 70 by the bulb grip finger assembly 160. FIG. 12B is a rear perspective view of FIG. 12A. After a selected delay time, for example approximately 5 seconds, the second relay control 44 then turns on and replacement bulb 75 gets threaded in place inside socket 100 by cup holder 122 moving upward in the direction of arrow 114RS by cam follower bar 150 being moved by cam transfer arm 50, while simultaneously rotating in a clockwise direction as shown by arrow S. The second relay control 44 can be set by knob 45 to a selected time period, such as but not limited to approximately 15 seconds, after which the second relay control 44 times out. After being activated, third relay control 48 operates servo motor 180 causing moveable grip finger 172 to close in the direction of arrow G1 about threaded stem 72 of burned out bulb 70.

Replacement Finished, Burned Out Bulb Discarded

Figure 13A:
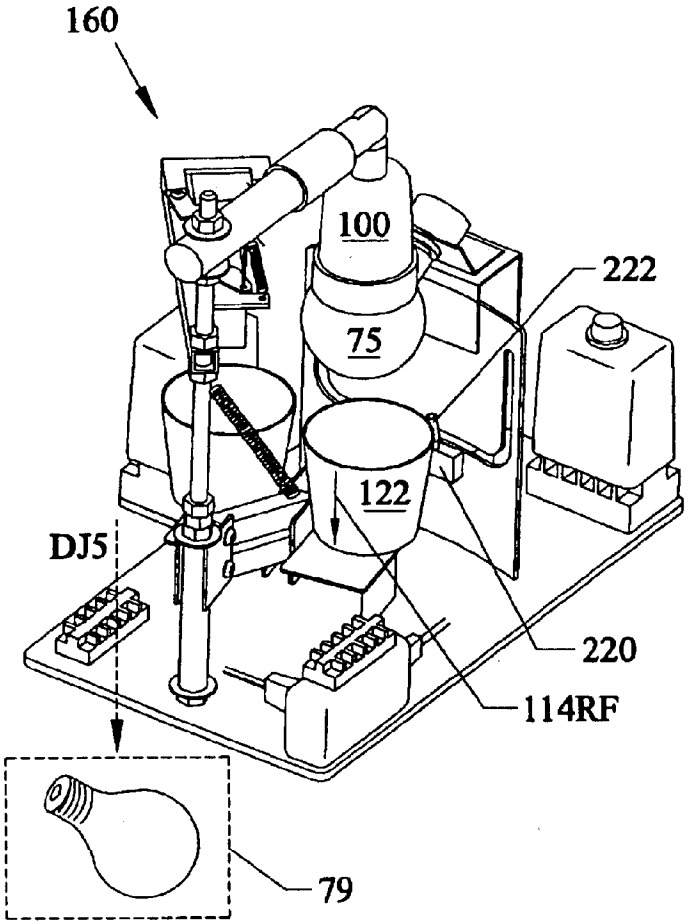
FIG. 13A is a front perspective view of the transport arm of the changer separating from the replacement bulb, while the changer releases the burned out bulb.
Figure 13B:
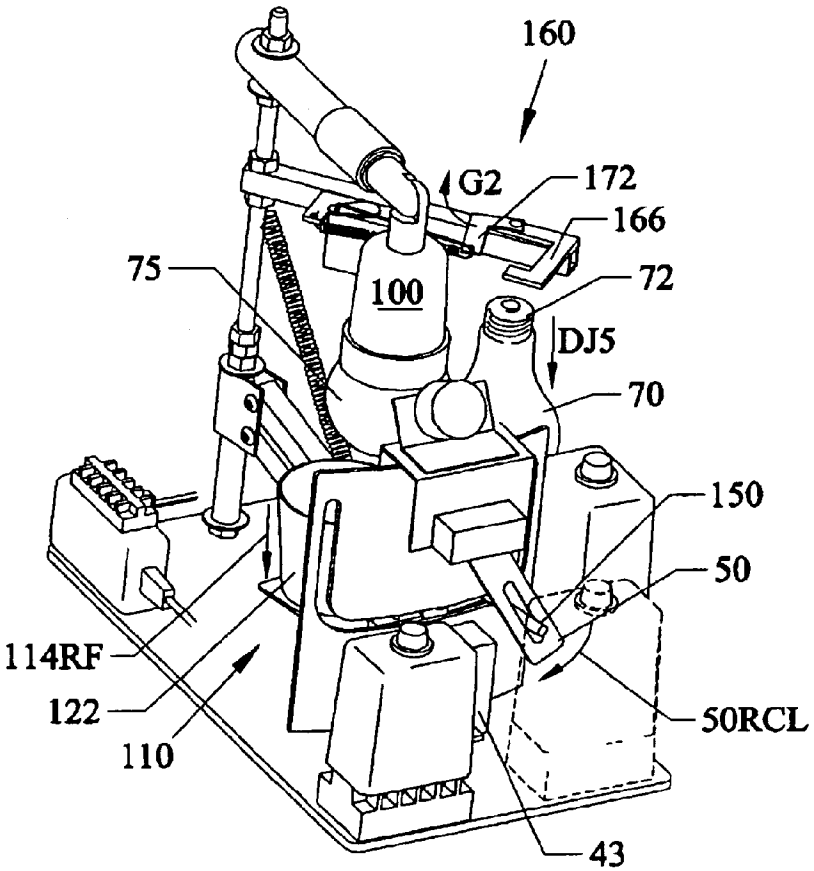
FIG. 13B is a rear perspective view of FIG. 13A.

FIG. 13A is a front perspective view of the transport arm assembly 110 of the changer 1 separating from the replacement bulb 75, while the changer 1 releases the burned out bulb 70. FIG. 13B is a rear perspective view of FIG. 13A. After a set time, the cam arm 50 starts to rotate clockwise in the direction of arrow 50RCL dropping articulating transfer arm assembly 110 downward in the direction of arrow 114RF lowering cup holder 122 from the replacement bulb 75 that is now screwed onto socket 100. After cam follower arm 150 pushes toggle stem 222 of switch 220 in an opposite direction, the moveable gripping finger 172 opens in the direction of arrow G2 releasing the threaded stem 72 of burned out bulb 70 to drop downward in the direction of arrow DIS to be discarded to a receptacle 79, for disposal, and/or recycling at a later time.

Figure 14A:
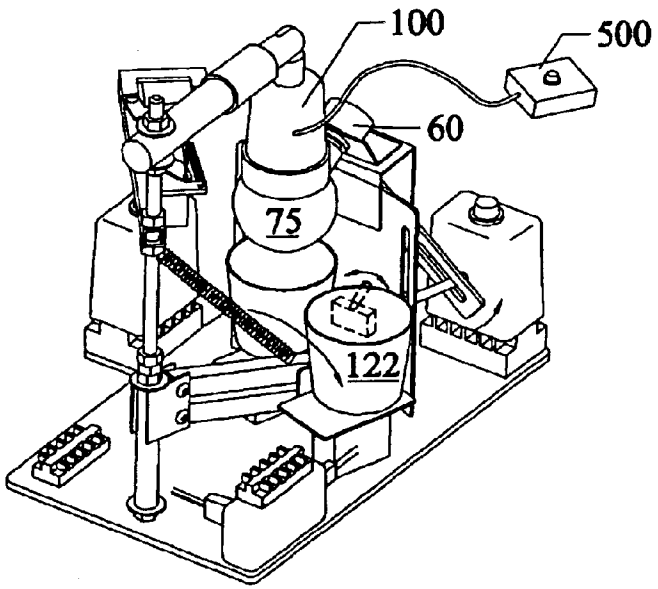
FIG. 14A is a front perspective view of the changer moved back to the FIG. 7A position.
Figure 14B:
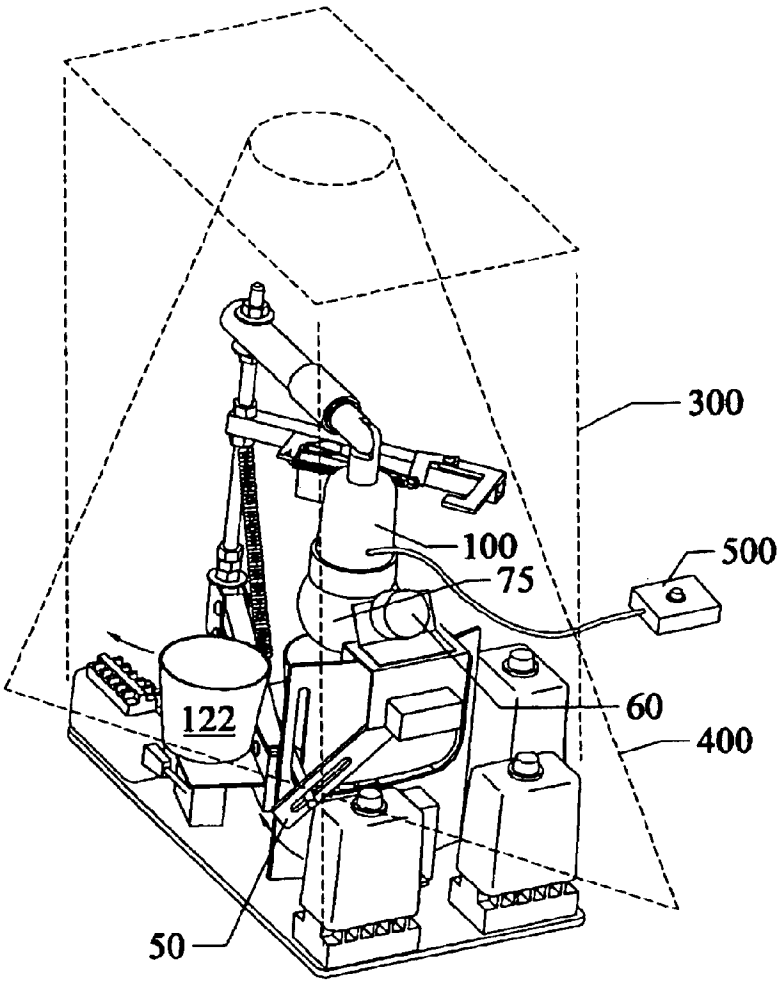
FIG. 14B is a rear perspective view of FIG. 14A.

FIG. 14A is a front perspective view of the changer moved back to the FIG. 7A position. FIG. 14B is a rear perspective view of FIG. 14A. The changer 1, can now accept another replacement bulb in cup holder 122, and then be turned on, where the changer can repeat the novel steps and operation described above after another burned out bulb condition is detected by sensor 60.

Novelty Embodiment

Referring to FIGS. 14A-14B, the invention can be used for novelty effects where the device is protected under a see-through cover or shield 300, on countertops, tables in residential type homes, or commercial establishments such as bars, restaurants, and the like. A demonstration switch 500 such as a push button switch, and the like, can be used to momentarily turn on a burned out condition in bulb 70 so that users can visualize the mechanical operation of the changer 1. Alternatively, switch 500 can include a coin/money operated slot, and the like, so that the changer 1 can be used in public entertainment type applications, such as those found in restaurants, and the like, for novelty and entertainment applications of the changer 1.

Useful Light Source Embodiment

Referring to FIG. 14B, the invention can also be used as a useful light source, by using a removable shade 400, and the like to cover the components, as needed.

Figure 15:
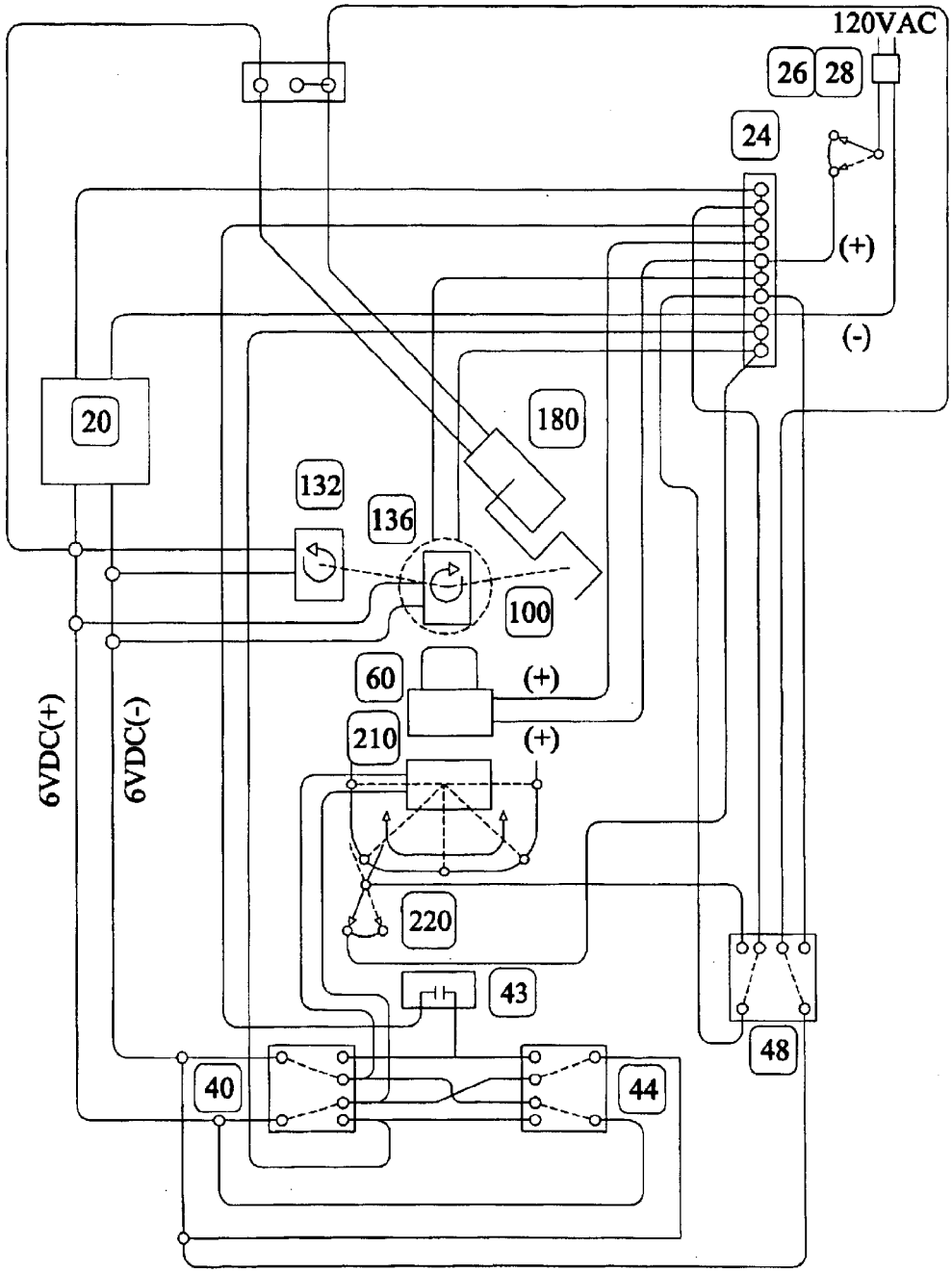
FIG. 15 is a block diagram of the electrical circuit that can be used in the preferred embodiment.
Figure 16A:
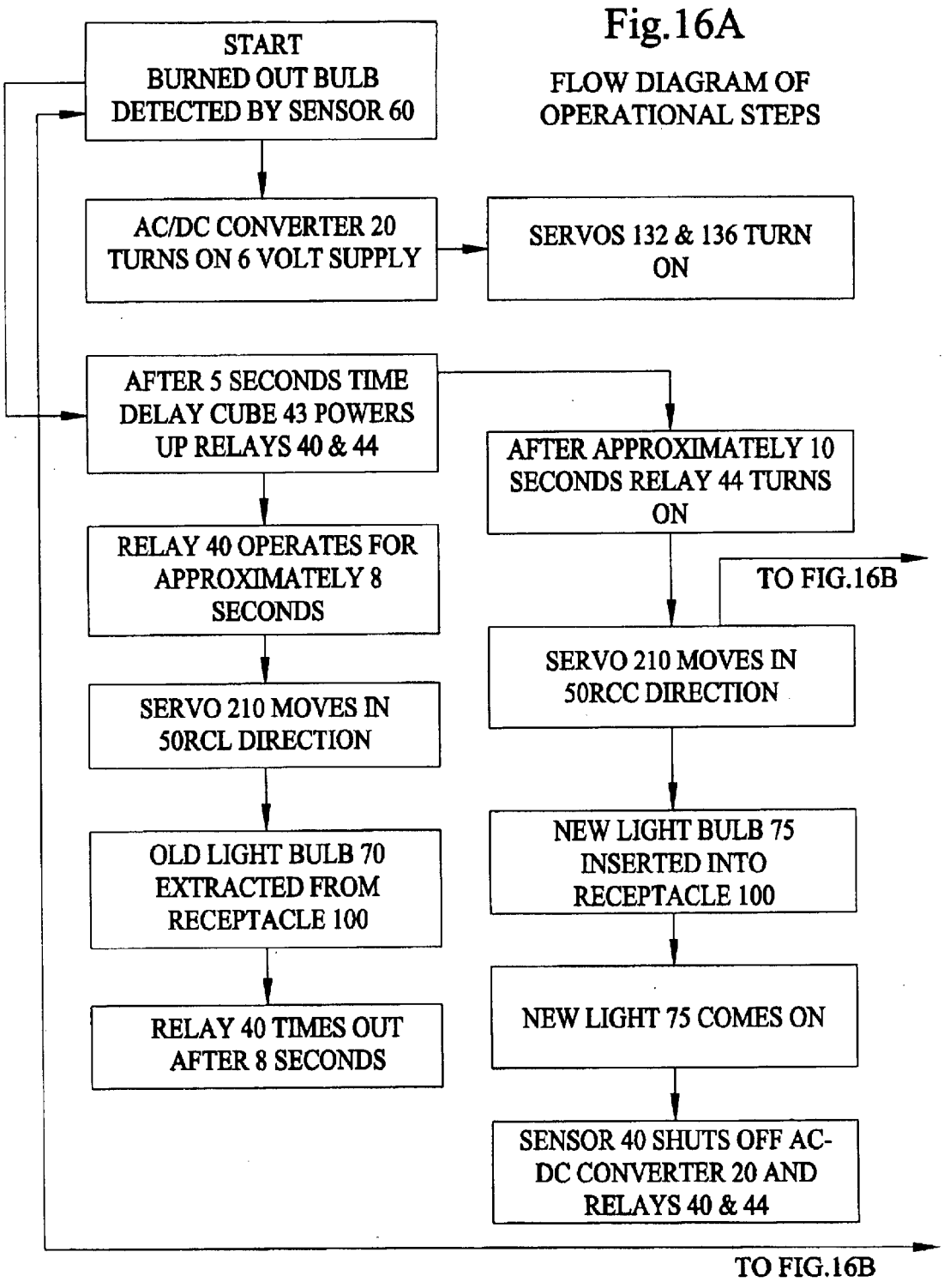
FIG. 16 is a flow diagram of the operational steps of the novel invention.
Figure 16B:
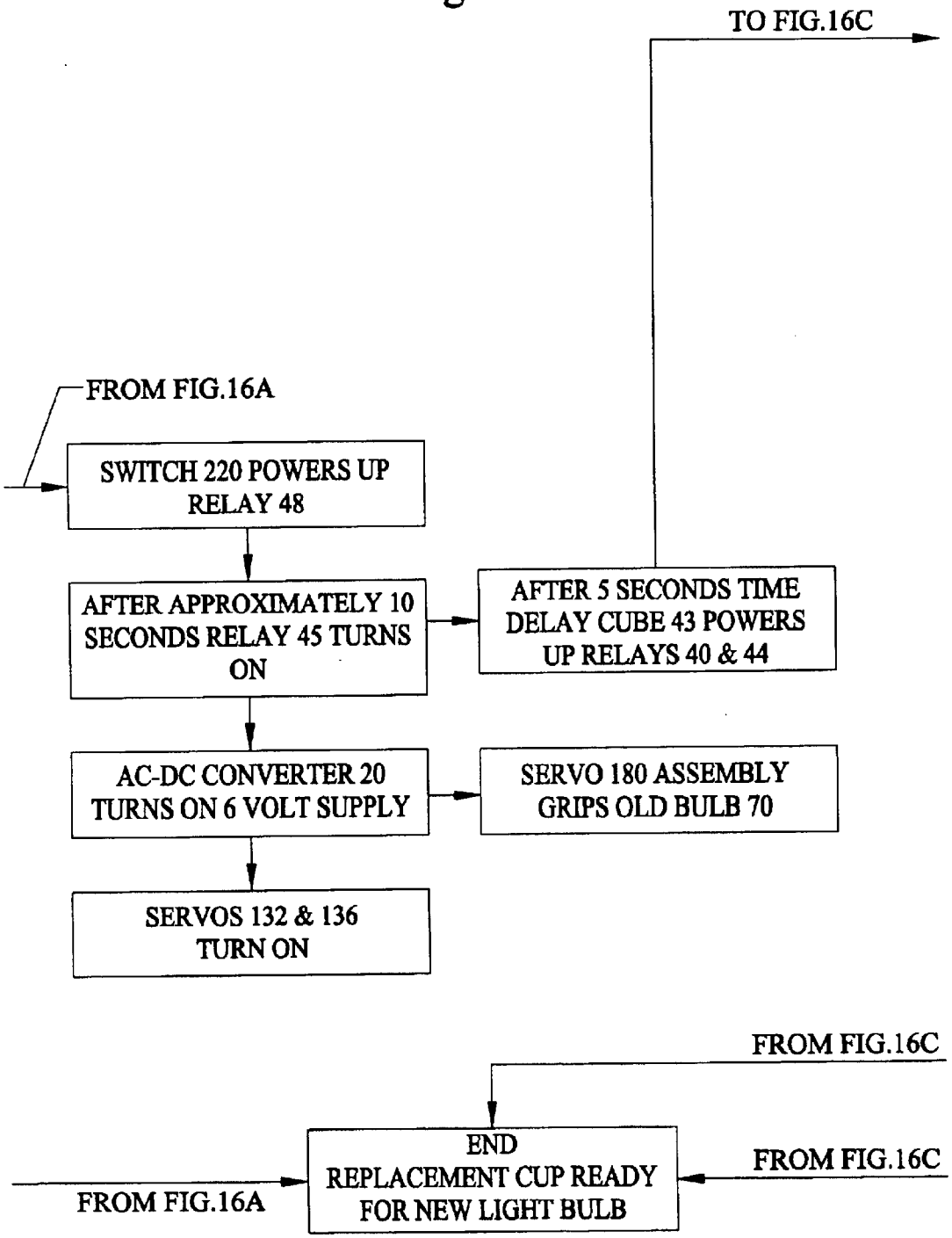
Figure 16C:
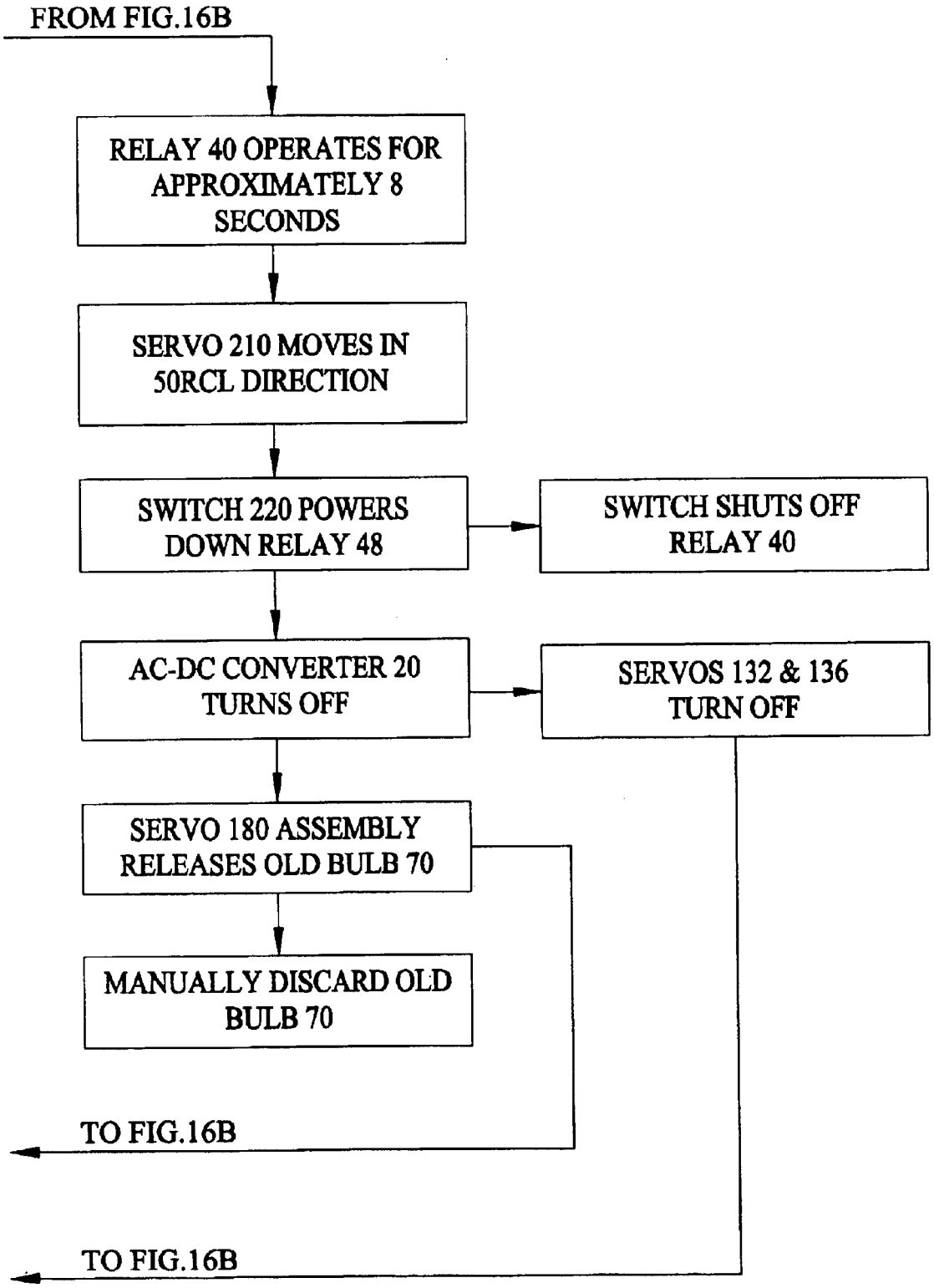

FIG. 15 is a block diagram of the electrical circuit that can be used in the preferred embodiment. A list of the components that can be used in the circuit will now be described. Component 20 refers to a 120VAC to 6 VDC converters such as a 1000 milliamp Radio Shack AC to DC Converter part # 273-1762. Part 60 refers to a UL listed photo electric switch rated for 120 VAC, such as ACE hardware part # 870J. Part 40 refers to a time delay relay interval type with range 0.1 to 10 seconds with a contact rating of 10 amps at 120 VAC, such as Dayton part #6X603N with matching octal socket. Component 43 refers to a solid state relay time on delay type with timing range 0.25 to 5 seconds, having input and output contact ratings of 1 amp at 120VAC, such as Dayton part #2A560 with standard press on electrical connectors. Component 44 refers to a time delay relay on delay type with timing range 1–60 seconds with contact ratings of 10 amps at 120VAC such as Dayton part # 5YZ85M with matching octal socket. Component 48 refers to a time delay relay on delay type with timing range 1–180 seconds with contact ratings of 10 amps at 120 VAC, such as Dayton part # 5X829N with matching octal socket. Component 220 refers to Radio Shack single pole double throw toggle switch rated 3 amps at 120VAC with solder end connectors, toggle lever modified with applied small diameter neoprene flex tubing. Components 26/28 refer to a UL listed replacement power supply cord with inline on/off switch, such as ACE Hardware issue # BW2293 cord rated at 10 amps 120VAC. Components 132/136/210 refer to a three-standard remote control Futaba S3003 5V high torque servo motors modified to accommodate direct DC +/– wired directly to interval 5V motor. Component 24 refers to a standard 6 connector terminal block with ⅜ inch dimension between terminal centers, rated for 10 amps 120 VAC. 100 refers to standard UL rated light fixture 150 Watts Par 38, such as those sold under the mark Campax®. The wiring used in the electrical block circuit can be 16 AWG rated wire or higher for all 120 VAC service ratings.

Figure 17:
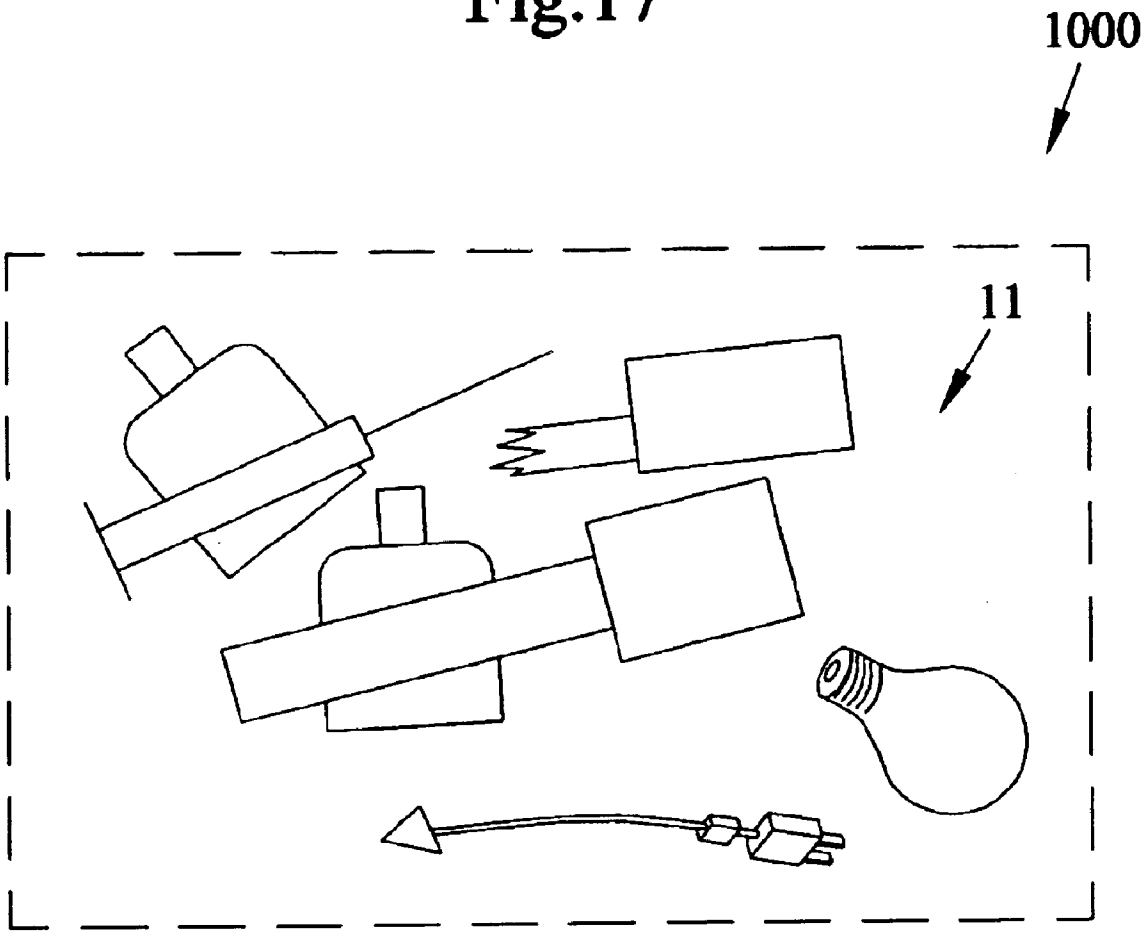
FIG. 17 shows a box version holding a kit form of the novel invention.

FIG. 17 shows a box/package 1000 that can contain disassembled components 1' of the novel changer 1, so that the invention can be used in a kit form, and the like.

The invention can be in a kit form, packaged and sold in a disassembled state that includes a light fixture, on which the detecting means, removing means, and replacing means are mounted with the light fixture.

The invention can be useful as an actual light source for use by consumers. The invention can have special applications for consumers with handicaps that are not able to easily replace existing light bulbs in an efficient manner.

The invention can be used as a retrofit for existing light fixtures, where the detecting means, removing means and replacing means can be mounted by a user to an existing light fixture, such as a table lamp, ceiling fixture, and the like.

Although the invention has been described for being used with light sources such as light bulbs, the invention can be used with other types of lights such as but not limited to fluorescent lights, and the like, having different shapes, and the like, from globe shaped to tubular shaped, and the like. Thus, different types and shapes of lights can be used.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A light bulb changer apparatus, comprising:

means for immediately detecting a burned out condition in a light bulb;

means for automatically removing the burned out bulb upon; and means for automatically replacing the burned burned out bulb with a replacement bulb, wherein the detecting means, removal means, and replacing means occurs automatically in succession without human intervention.

2. The light bulb changer apparatus of claim 1, further comprising:

a light fixture.

3. The light bulb changer apparatus of claim 1, wherein the detecting means includes: an optical light sensor.

4. The light bulb changer apparatus of claim 1, wherein the detecting means includes: a power switch.

5. The light bulb changer apparatus of claim 1, wherein the automatic removing means and the automatic replacing means each includes: a cone shaped sleeve for slipping about a portion of the burned out bulb and the replacement bulb.

6. A method of automatically replacing burned out light bulbs, comprising the steps of:

instantly detecting a burned out condition in a light bulb supported in a fixture;

automatically removing the burned out bulb from the fixture; and automatically replacing the burned out bulb in the fixture with a replacement bulb, wherein the steps of detecting, removing, and replacing occurs in automatic succession without human intervention.

7. The method of claim 6, wherein the detecting step includes the step of:

detecting the burned out condition with an optical sensor.

8. The method of claim 6, wherein the detecting step includes the step of:

detecting the burned out condition with a power current sensor.

9. The method of claim 6, wherein the automatically removing and the automatically replacing steps include the steps of:

rotating the burned out bulb from the fixture in one direction; and rotating the replacement bulb into the fixture in an opposite direction.

10. A method of assembling an automatic changer for an existing light fixture having an existing light source, from a kit, comprising the steps of:

providing a component for detecting a burned out condition from the existing light source, a component for removing the burned out light source and a component for replacing the burned out light source, and an additional light source;

assembling the detecting component, the removing component and the replacing component from the kit into an assembly;

and retrofitting the existing light fixture with the assembly; and automatically detecting the burned out condition from the existing light source on the existing light fixture by the assembly;

automatically removing the existing light source having the burned out light condition, and automatically replacing the existing light source having the burned out light condition with the additional light source, wherein the steps of detecting, removing, and replacing occurs in automatic succession without human intervention.

11. The method of claim 10, wherein the detecting step includes the step of:

detecting the burned out condition with an optical sensor.

12. The method of claim 10, wherein the detecting step includes the step of:

detecting the burned out condition with a power current sensor.

13. The method of claim 10, wherein the automatically removing and the automatically replacing steps include the steps of:

rotating the burned out light source from the fixture in one direction; and rotating the additional light source into the fixture in an opposite direction.

* * * * *